United States Patent [19]

Gohm

[11] 4,113,611

[45] Sep. 12, 1978

[54] MAGNETIC PIPE CLEANER

[75] Inventor: William G. Gohm, Springfield, Pa.

[73] Assignee: Westinghouse Electric Corp., Pittsburgh, Pa.

[21] Appl. No.: 742,474

[22] Filed: Nov. 16, 1976

[51] Int. Cl.[2] ..... B03C 1/28

[52] U.S. Cl. ..... 209/215; 15/104.16; 126/16; 166/65 M; 335/305; 210/222

[58] Field of Search ..... 209/215, 223 R, 217; 15/104.16; 137/238, 244, 242; 335/305; 126/16; 210/222; 166/279, 292, 65 M

[56] References Cited

U.S. PATENT DOCUMENTS

| | | | |
|---|---|---|---|
| 555,976 | 3/1896 | Secor | 15/104.16 |
| 697,331 | 4/1902 | Demquest | 15/104.16 |
| 974,047 | 10/1910 | Frederickson | 209/217 |
| 2,242,830 | 5/1941 | Lisle | 335/305 |
| 2,700,506 | 1/1955 | Fortenberry | 166/65 M |
| 2,825,464 | 3/1958 | Mack | 210/222 |
| 3,124,821 | 3/1964 | Mathews | 15/104.16 |
| 3,500,855 | 3/1970 | Schaible | 137/242 |
| 3,630,352 | 12/1971 | Murse | 209/223 R |
| 3,637,033 | 1/1972 | Mayall | 166/65 M X |

FOREIGN PATENT DOCUMENTS

| | | | |
|---|---|---|---|
| 50,194 | 4/1909 | Austria | 126/16 |
| 504,726 | 8/1954 | Canada | 209/223 R |
| 1,282,694 | 12/1961 | France | 210/222 |
| 200,249 | 7/1923 | United Kingdom | 15/104.16 |

*Primary Examiner*—Robert Halper
*Attorney, Agent, or Firm*—F. J. Baehr, Jr.

[57] ABSTRACT

A nonmetallic disc has a plurality of kerfs extending radially inwardly from the outer periphery. Magnets are disposed in the bottom of the kerfs so as to form a space between the magnets and the outer periphery of the disc to collect magnetic particulate material in this space. An eyelet is provided for attachment to a cable for pulling the disc through a pipe to remove magnetic debris therefrom.

6 Claims, 2 Drawing Figures

MAGNETIC PIPE CLEANER

BACKGROUND OF THE INVENTION

This invention relates to pipe cleaners and more particularly to a magnetic pipe cleaner.

Steam and oil piping in power plants must be thoroughly cleaned prior to placing turbines and generators in service as metallic debris such as welding rod slag and other debris find its way into the piping during construction or repair of piping systems and if not removed prior to starting up the system, the debris may result in damage to bearing, valves or the turbine blades and result in costly repairs and even shutdown of the unit. Therefore, removal of such debris prior to start-up is essential to assure safe and reliable operation of the equipment.

SUMMARY OF THE INVENTION

In general a magnetic pipe cleaner, when made in accordance with this invention, comprises a cylindrical plug slightly smaller in diameter than the pipe to be cleaned, and an eyelet for attaching a cable to the plug. The plug has a plurality of kerfs extending radially inwardly from the outer periphery and a plurality of magnets are disposed in the kerfs. The magnets are so disposed in the kerfs that there is a space between the outer periphery of the plug and the magnet, whereby when pulled through a pipe, magnetic debris is collected in the space adjacent the periphery of the plug, thus removing magnetic debris therefrom.

BRIEF DESCRIPTION OF THE DRAWINGS

The objects and advantages of this invention will become more apparent from reading the following detailed description in connection with the accompanying drawings, in which.

BRIEF DESCRIPTION OF THE PREFERRED EMBODIMENT

Figure 1:
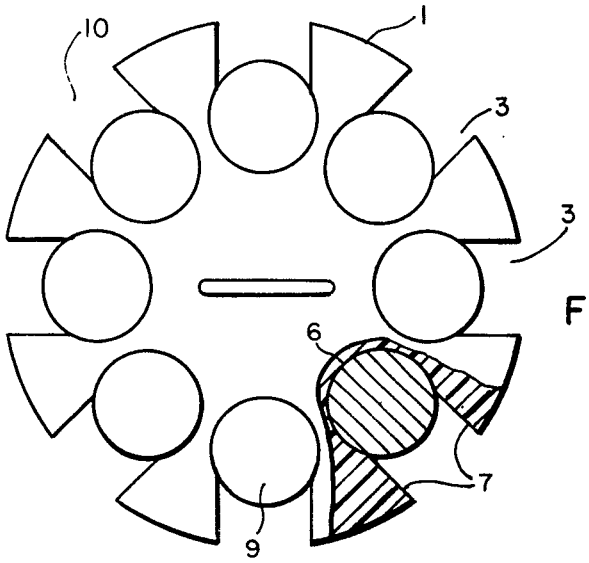
FIG. 1 is an end view of a magnetic pipe cleaner made in accordance with this invention.
Figure 2:
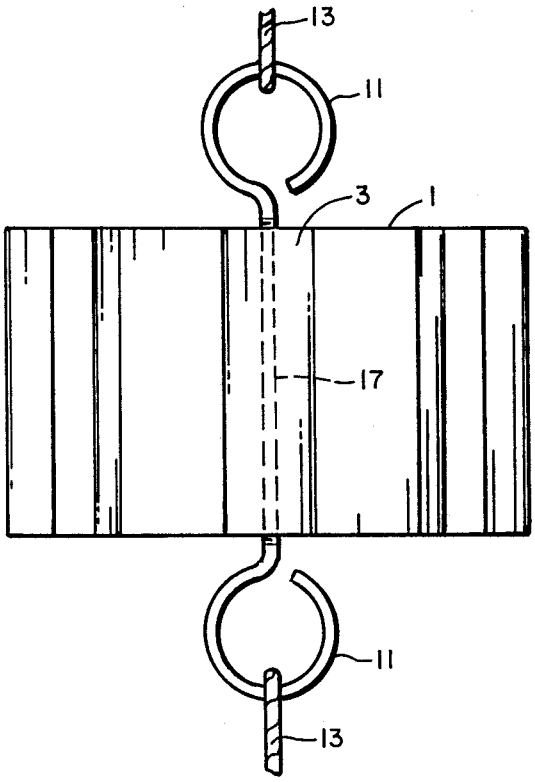
FIG. 2 is an elevational view of the pipe cleaner.

Referring now to the drawings in detail, FIGS. 1 and 2 show a cylindrical plug or disc 1 made of Micarta® or other nonmagnetic material. The plug 1 has a plurality of kerfs or grooves 3 extending inwardly from the outer periphery disposed in a radial array. The bottom or radially inward ends 6 of the kerfs or grooves 3 are preferably cylindrically shaped or have a rounded or circular cross section. Preferably the grooves are formed by drilling the plug and then milling or saw-cutting a radial slot 7 so that it intersects the drilled holes. The slots 7 may be slightly narrower than the diameter of the hole.

Cylindrically-shaped magnets 9 are inserted in the bottom 6 of the kerfs 3 and may be locked therein by end plugs, adhesives or other means. The magnets 9 are so disposed in the kerfs 3 to provide a space 10 between the outer periphery of the plug 1 and the magnet 9 so that particulate magnetic material attracted to the magnets will be removed from the contact interface of the plug and the pipe preventing damage to the pipe and jamming of the plug within the pipe. Eye bolts 11 are attached to opposite ends of the plug 1 to provide means for attaching a cable 13 to the plug 1. The eye bolts 11 are mounted in an axially disposed hole 17 extending axially through the plug 1. Other means for attaching a cable to the plug could be employed. For example, a cable could be threaded through the axial hole 17 and stops could be attached to the cable 13 on opposite sides of the plug. The use of a cable with the plug allows the plug to be pulled through curved as well as straight sections of the pipe. With a cable fastened at both ends of the plug, the plug 1 may be pulled through the pipe in one direction and if it becomes jammed, it can be pulled back out in the direction from which it was pulled into the pipe.

As shown in FIG. 1 the magnets 9 may have a circular cross section and if the groove is made by saw cuts or milling and is slightly thinner than the diameter of the hole, the magnets are prevented from moving radially with respect to the plug; however, they must be secured to prevent axial movement. Magnets having approximately a 2-lb. pull have been found to work satisfactorily. The magnetic plug cleaner hereinbefore described is simple, cheap to manufacture, and does an excellent job in removing magnetic debris from within piping systems.

What is claimed is:

1. A magnetic pipe cleaner comprising a cylindrical non-magnetic plug slightly smaller in diameter than the pipe to be cleaned, means for attaching a cable to said plug, said plug having a plurality of radially disposed kerfs extending inwardly from the outer periphery thereof, a plurality of magnets disposed in the bottom portions of said kerfs, said magnets being so disposed in said kerfs so that there is a space between the outer periphery of the plug and the magnet, whereby when pulled through a pipe magnetic debris is collected in the space between the magnet and the outer periphery of the plug and is removed from the pipe.

2. The magnetic pipe cleaner as set forth in claim 1, wherein the kerfs have a circular bottom portion and cylindrically-shaped magnets are disposed in the bottom portion of the kerfs.

3. The magnetic pipe cleaner as set forth in claim 2, wherein the circular portion of the kerfs are slightly larger in diameter than the width of the remaining portions of the kerfs to lock the magnets within the kerf.

4. The magnetic pipe cleaner as set forth in claim 1, wherein the means for attaching a cable to the plug comprises an eye bolt and the plug has an axially disposed hole for receiving the eye bolt.

5. The plug set forth in claim 1, wherein the means for attaching a cable to the plug comprises a pair of eye bolts disposed on each end of the plug and the plug has an axially disposed hole for receiving the eye bolts.

6. The magnetic pipe cleaner as set forth in claim 1, wherein each magnet generally has a 2-pound pull.

* * * * *